US009085835B2

(12) United States Patent
Tang

(10) Patent No.: US 9,085,835 B2
(45) Date of Patent: Jul. 21, 2015

(54) KIND OF MICROFIBER ARTIFICIAL LEATHER AND ITS MANUFACTURING METHODS

(76) Inventor: Weiren Tang, Hangzhou (CN)

( * ) Notice: Subject to any disclaimer, the term of this patent is extended or adjusted under 35 U.S.C. 154(b) by 722 days.

(21) Appl. No.: 13/203,665

(22) PCT Filed: Jan. 13, 2011

(86) PCT No.: PCT/CN2011/000055

§ 371 (c)(1),
(2), (4) Date: Feb. 10, 2012

(87) PCT Pub. No.: WO2012/062020

PCT Pub. Date: May 18, 2012

(65) Prior Publication Data

US 2013/0000772 A1 Jan. 3, 2013

(30) Foreign Application Priority Data

Nov. 11, 2010 (CN) ..... 2010 1 0539516
Nov. 11, 2010 (CN) ..... 2010 2 0601285 U

(51) Int. Cl.

*D03D 39/00* (2006.01)
*D03D 27/06* (2006.01)
*D03D 25/00* (2006.01)

(Continued)

(52) U.S. Cl.

CPC ..... *D03D 27/06* (2013.01); *D03D 15/0061* (2013.01); *D03D 15/12* (2013.01); *D03D 25/005* (2013.01); *D06N 3/0004* (2013.01); *D06N 3/004* (2013.01); *D06N 3/0006* (2013.01); *D06N 3/0072* (2013.01); *D06N 3/0075* (2013.01); *D06N 2205/24* (2013.01); *D06N 2211/28* (2013.01)

(58) Field of Classification Search

None
See application file for complete search history.

(56) References Cited

U.S. PATENT DOCUMENTS 1,785,937 A * 12/1930 Curtis ..... 156/148
3,865,678 A * 2/1975 Okamoto et al. ..... 428/91

(Continued)

FOREIGN PATENT DOCUMENTS

CN 1625626 A 6/2005
CN 101457482 A 6/2009

(Continued)

OTHER PUBLICATIONS

Aug. 25, 2011 International Search Report issued in PCT/CN2011/000055 (with translation).

(Continued)

*Primary Examiner* — Erma Cameron
(74) *Attorney, Agent, or Firm* — Oliff PLC

(57) ABSTRACT

This Invention relates to a kind of microfiber artificial leather and its manufacturing methods, namely, adopting double-pile weaving process, taking highly-strengthened filament (or other filament) as ground warp and ground weft, using sea-island polyester microfiber or other microfiber as pile warp, adopting the V-shaped or W-shaped consolidation to weave into three-dimensional fabric, and then accepting padding of polyurethane resins, alkali treatment, sanding, dyeing and finishing. The artificial leather related in this Invention features delicate surface piles, high density, strong cortical feeling, good wear resistance, dimensional stability, good moisture permeability, good color fastness, and excellent mechanical properties, so it can be used as garment leather, shoe upper leather, car interior materials, furniture leather and so on.

18 Claims, 3 Drawing Sheets

(51) Int. Cl.

| | |
|---|---|
| ***D06N 3/00*** | (2006.01) |
| ***D03D 15/00*** | (2006.01) |
| ***D03D 15/12*** | (2006.01) |

(56) References Cited

U.S. PATENT DOCUMENTS

| | | | | |
|---|---|---|---|---|
| 4,415,611 | A * | 11/1983 | Yamagata et al. | 428/15 |
| 4,939,006 | A * | 7/1990 | Nakajima et al. | 428/15 |
| 7,820,569 | B2 | 10/2010 | Hwang et al. | |
| 7,896,997 | B2 | 3/2011 | Hwang et al. | |
| 2004/0055659 | A1 * | 3/2004 | Hugh Silver | 139/396 |
| 2005/0009426 | A1 | 1/2005 | Hwang et al. | |
| 2007/0151654 | A1 | 7/2007 | Hwang et al. | |

FOREIGN PATENT DOCUMENTS

| | | |
|---|---|---|
| JP | A-56-159370 | 12/1981 |
| JP | A-10-273886 | 10/1998 |
| JP | A-2006-342436 | 12/2006 |

OTHER PUBLICATIONS

Aug. 25, 2011 Written Opinion issued in PCT/CN2011/000055 (with translation).

* cited by examiner

KIND OF MICROFIBER ARTIFICIAL LEATHER AND ITS MANUFACTURING METHODS

TECHNICAL FIELD

This Invention relates to a kind of microfiber artificial leather and its manufacturing methods, more precisely, a kind of suede made taking ultrafine polyester as the major raw material, applying a special three-dimensional weaving process, using a special macromolecule polymer elastomer and adopting the wet leather manufacturing process, as well as corresponding manufacturing methods. It is a kind of textile and leather technology.

BACKGROUND ART

Currently, the microfiber artificial leather produced abroad and at home mostly takes the sea-island superfine fiber as raw materials, experiences the opening, carding and netting process, accepts repeated consolidation on a acupuncture (or spunlace) machine to form a fabric, then has the sea part dissolved (or extracted) by polyurethane padding, coagulation and lye (or solvent) treatment, and finally accepts sanding, dyeing and finishing to make into finished products.

According to different production technologies, the sea-island superfine fiber can be divided into volatile sea-island superfine fiber (volatile island microfiber) and fixed sea-island microfiber (fixed island microfiber). The island in volatile sea-island microfiber is not controllable, featuring non-continuity on the vertical axis, and can be made into microfiber featuring irregular thickness and length through solvent treatment; however, the fixed sea-island microfiber is continuous on the vertical axis, and a kind of symmetrical microfiber featuring a fixed number of islands, as well as consistent fiber and uniform length. The number of islands in fixed sea-island microfiber generally includes such specifications as 16 islands, 24 islands, 37 islands and 64 islands, with 37 islands in common use.

For the nylon microfiber artificial leather featuring volatile island, its volatile island microfiber is usually blended with polyamide and polyethylene or other soluble macromolecule polymer materials at a certain percentage based on the threading process, after the artificial leather fabric is fabricated, and then toluene is used to dissolve polyethylene for fiber opening followed by post-processing. The products based on this process have the fiber monofilament size up to 0.0001 dtex (for fine ones) and 0.1 dtex above (for thick ones). The larger discreteness of size may have certain effect on post-processing and product quality; and, in the process of production, the toxic solvent toluene is easy to evaporate, which has great influence on operators' health and environment. Moreover, the characteristics of nylon fiber itself indicates that related products feature poor uniformity, low color fastness, poor abrasion resistance, no dense hair, low density and other defects, so that there should be certain limitations to its applications.

Non-woven fabric is used as artificial leather fabric, and acupuncture (or spunlace) is adopted to have the fibers tangled together, but this entanglement has its instability, (and some manufacturers add a layer of woven fabric between non-woven fabrics to increase the stability of the product). Embedded with polyurethane resin, but the fiber is relatively easy to fall off from the product, that is, it features poor wear resistance. This process can not form enough three-dimensional fibers with sparse hair on the surface so that the products feel rough and can not meet requirements for use in some areas.

INVENTION DETAILS

In order to overcome the defects of artificial leather based on existing technology, such as no enough three-dimensional fiber, no dense hair on the surface, rough feeling and inability of meeting the use requirements in some fields, this Invention provides a manufacturing method for microfiber artificial leather, including the steps as follows:

(1) Microfiber (such as a microfiber dyed before spinning) is select as pile warp, with the filament or yarn (such as a yarn dyed before spinning) taken as ground warp and ground weft. The pile warp adopts V-shaped or W-shaped consolidation, uses the double warp-pile weaving technology to weave into double-layer pile fabric on pile weavers, and adopts pile cutters to cut the pile warp thread joining the two layers of the ground fabric so that the double-layer pile fabric could be halved into single-layer pile fabric respectively with ground warp, ground weft and V-shaped or W-shaped pile warp, featuring a three-dimensional structure;

(2) The pile fabric is immersed into polyurethane finishing liquid, padded, then treated in a coagulating liquid, washed and dried, so that the polyurethane in the pile fabric could form sponge-like continuous microporous membrane;

(3) After dried, the microporous membrane pile fabric with polyurethane contained is applied with alkali treatment, so that the pile warp could fully be dispersed into single fibers to form microfibers, and then fully washed in water to remove alkali liquid, as well as alkali-soluble monomers and oligomers;

(4) Carry out sanding, dyeing and finishing operations to obtain microfiber artificial leather.

According to the preferred technical solution of this Invention, the described microfiber shall be polyester microfiber, PTT microfiber, PA6 or PA66 microfiber, and the yarn is highly strengthened filament or other filament;

As another preferred implementation solution of this Invention, the microfiber is sea-island microfiber or split microfiber;

As another preferred implementation solution of this Invention, the multi-filament size of microfiber is 82.5-333 dtex;

As another preferred implementation solution of this Invention, the single filament size of microfiber is 0.55 dtex or below;

As another preferred implementation solution of this Invention, the multi-filament size of yarn is 82.5-222 dtex;

As another preferred implementation solution of this Invention, the polyester microfiber can adopt flame-retardant polyester microfiber, anti-static polyester microfiber, antibacterial polyester microfiber or polyester microfiber with the function of negative ions of oxygen emission;

As another preferred implementation solution of this Invention, the polyurethane resin finishing liquid described in Step (2) is a kind of solution prepared by polyurethane, DMF and anionic, and non-ionic surfactant;

As another preferred implementation solution of this Invention, the polyurethane resin in polyurethane finishing solution has its concentration of 5%-30%, and the weight ratio of anionic and nonionic surfactants is 0-5%;

As another preferred implementation solution of this Invention, the polyurethane resin has its concentration of 10%-20%, and the weight ratio of anionic and nonionic surfactants is 1-3%;

As another preferred implementation solution of this Invention, the weight ratio between the polyurethane finishing liquid and pile fabric in Step (2) is 80%-400%;

As another preferred implementation solution of this Invention, the weight ratio between the polyurethane finishing liquid and pile fabric in Step (2) is 100%-200%;

As another preferred implementation solution of this Invention, the coagulating liquid in Step (2) has the concentration of 10-30%;

As another preferred implementation solution of this Invention, the alkali treatment in Step (3) has its temperature of 95-120 degrees, with the time of 10-30 minutes;

As another preferred implementation solution of this Invention, the ground warp and ground weft in Step (1) can adopt producer-colored yarn;

As another preferred implementation solution of this Invention, the pile warp in Step (1) can adopt producer-colored microfiber;

As another preferred implementation solution of this Invention, after the pile fabric has been made, Step (1) also includes another step to coat a layer of sea-island superfine polyester non-woven fabric on the back of the hair surface;

As another preferred implementation solution of this Invention, after the microfiber artificial leather has been made, Step (4) also includes another step to coat a layer of water-soluble polyurethane.

Another technical solution of this Invention is to obtain polyester microfiber artificial leather based on the above-mentioned manufacturing methods;

The preferred solution for the invention is that artificial leather adopts yarn as ground warp and ground weft. The pile warp adopts V-shaped or W-shaped consolidation, uses the double warp-pile weaving technology to weave into double-layer pile fabric on pile weavers, and adopts pile cutters to cut the pile warp thread joining two layers of ground fabric so that the double-layer pile fabric could be halved into single-layer pile fabric respectively with ground warp, ground weft and V-shaped or W-shaped pile warp, featuring a three-dimensional structure;

Another preferred solution of this Invention is to coat a layer of sea-island superfine polyester non-woven fabric on the back of the hair surface.

Another preferred solution of this Invention is to coat a layer of water-soluble polyurethane on the back of the hair surface.

Another technical solution of this Invention is the applications of microfiber artificial leather as garment leather, shoe leather, automotive interior materials or furniture leather.

The artificial leather of this Invention features fine and smooth hair surface, high density, strong cortical feeling, good wear resistance, dimensional stability, good moisture permeability, good color fastness and excellent mechanical properties, able to be used as garment leather, shoe upper leather, car interior materials, furniture leather and so on.

DESCRIPTIONS OF FIGURES

SPECIFIC IMPLEMENTATION

Here follows the further detailed description of this Invention based on the figures and specific implementation, but such specific implementation shall not be used to limit the protection scope of this Invention.

Example 1

Figure 1:
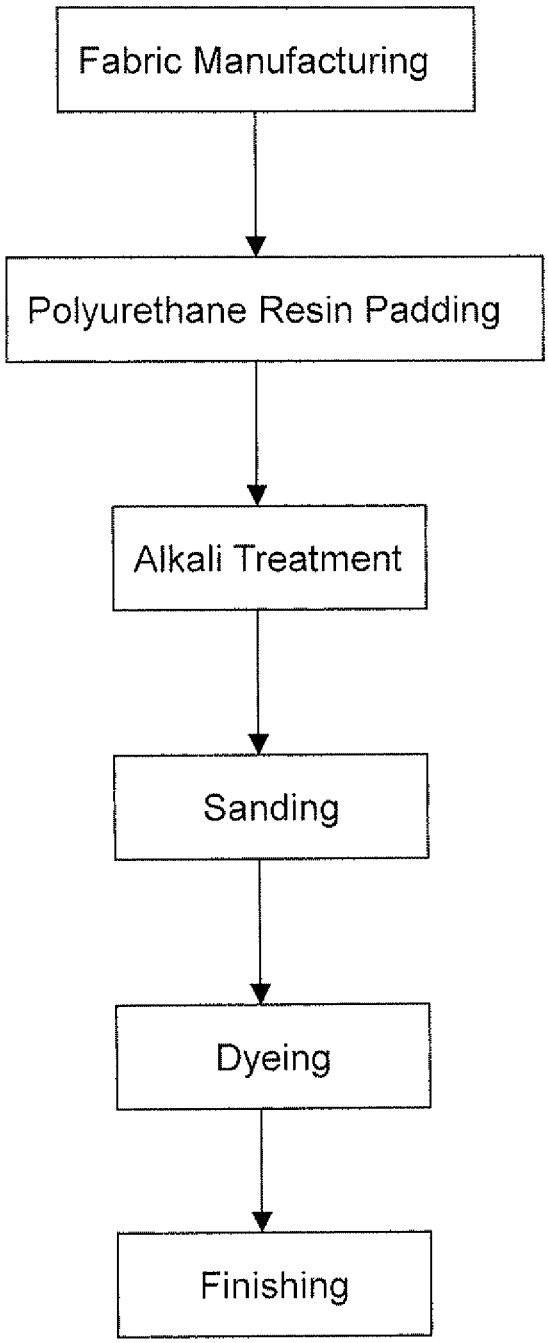
FIG. 1 shows the flow chart of the method mentioned in this Invention.
Figure 2:
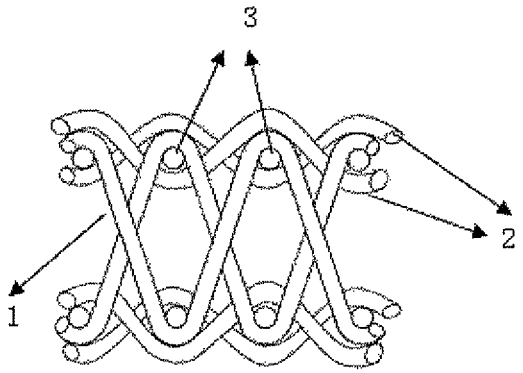
FIG. 2 shows the structure profile of pile warp V-shaped consolidation in this Invention.
Figure 3:
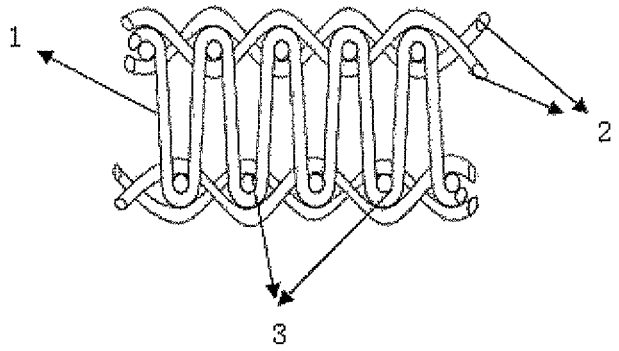
FIG. 3 shows the structure profile of pile warp V-shaped consolidation in this Invention.
Figure 4:
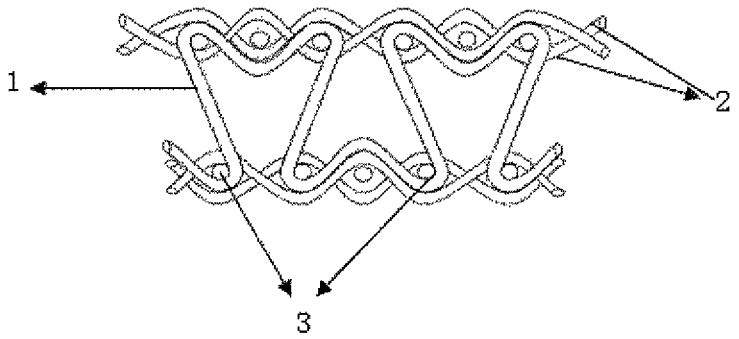
FIG. 4 shows the structure profile of pile warp W-shaped consolidation in this Invention.
Figure 5:
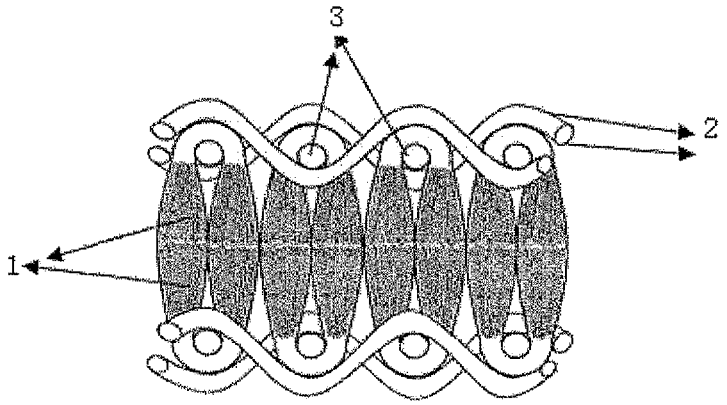
FIG. 5 shows the structure profile of double-layered pile fabric in this Invention.
Figure 6:
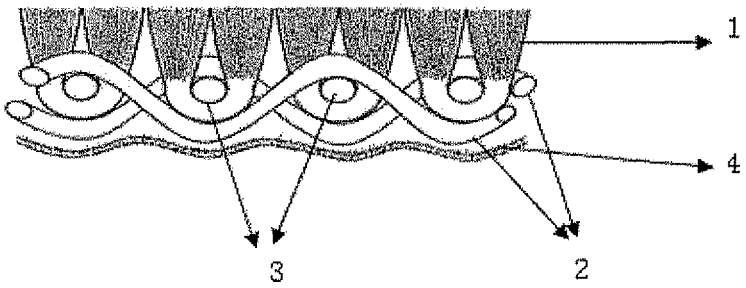
FIG. 6 shows the structure profile of single-layered pile fabric in this Invention.

1. Take the polyester sea-island microfiber with the microfiber filament size of 82.5-333 dtex (preferably with the microfiber filament size of 0.55 dtex or below) as pile warp (1), the highly-strengthened filament with the size of 82.5-222 dtex as ground warp (2) and ground weft (3). The pile warp (1) adopts V-shaped (as shown in FIG. 2 or FIG. 3) or W-shaped (as shown in FIG. 4) consolidation, uses the double warp-pile weaving technology to weave into double-layer pile fabric (as shown in FIG. 5) on pile weavers, and adopts pile cutters to cut the pile warp thread joining two layers of ground fabric so that the double-layer pile fabric could be halved into single-layer pile fabric (as shown in FIG. 6) respectively with ground warp (2), ground weft (3) and V-shaped or W-shaped pile warp (1) (which is called as rough surface), featuring a three-dimensional structure;

(2) Immerse the pile fabric with the finishing liquid containing 5%-30% polyurethane resin (preferably 10-20%), DMF, and 0-5% (preferably 1%-3%) anionic and non-ionic surfactant, in which weight ratio of polyurethane finishing liquid and pile fabric is 80%-400% (preferably 100%-200%). Then, the fabric shall be padded, immersed in coagulating liquid, washed in water, squeezed and dried;

Thereinto, the coagulating liquid is a kind of solution prepared by DMF with the weight ratio of 10%-30% (preferably 15%-25%) and water.

(3) Immerse the pile fabric with polyurethane contained after dried into alkaline solution, treat it under the temperature of 95-120 degrees for 10-30 minutes, dissolve the "sea" part in the sea-island polyester, fully disperse the "island" part to obtain the microfiber with the single filament size of 0.55 dtex or below, and then fully wash it in water to remove alkali, as well as alkali-soluble monomers and oligomers.

(4) Carry out sanding, dyeing and finishing, and obtain polyester microfiber artificial leather.

Thereinto, the sanding may have great impact on the plush feeling of the artificial leather hair surface, and this Invention adopts the sandpaper (220-600 meshes) surfaces of different types based on test to carry out several times of sanding treatment (first heavier, and then lighter) and obtain suedette artificial leather featuring standing hair and fine silky feeling.

Dyeing steps: Select high-quality dispersed dyes, such as those dispersed dyes featuring good wash fastness and excellent light fastness, make use of overflow dyeing machine for dyeing, strictly control the dyeing process conditions (130° C., 60 minutes), and strengthen after-dyeing wash to ensure uniform product color, pure shade and good color fastness.

(5) Coat with a layer of sea-island polyester microfiber (4) (as shown in FIG. 6) on the back of the hair-standing surface to further improve its wear resistance; or a layer of water-soluble polyurethane resin on the back of the hair surface to reduce the shedding of hair.

Example 2

Test the artificial leather microfiber obtained in Example 1 respectively from the gram weight, thickness, TABER wear resistance, flooding fade, bending at room temperature, bursting strength, tensile strength, elongation, tear strength, friction fade, peel strength and wet-type test, with the results as follows:

| Test Item | Unit | Test Results | Test Item | | Unit | Test Results |
|---|---|---|---|---|---|---|
| Gram weight | $g/m^2$ | 390 | Tensile strength | A-oriented | Kg/cm | 16 |
| Thickness | mm | 1.0 | | B-oriented | Kg/cm | 14 |
| Breadth | M | 1.4 | Elongation | A-oriented | % | 85 |
| TABER wear resistance | Cycles | No damage after 100,000 times | | B-oriented | % | 120 |
| Flooding fade | AATCC | 4.0 | Tear strength | A-oriented | Kg | 4.7 |
| Bending at room temperature | Cycles | No crack after 100,000 times | | B-oriented | kg | 4.2 |
| Bursting strength | $Kg/cm^2$ | 20 | Friction fade | Dry-type | ATCC | 4.5 |
| Peel strength | Kg/cm | 3.4 | | Wet-type | AATCC | 4.0 |

Above shows the detailed description of this Invention structure and its working process, but it can not be determined that the specific implementation of this Invention be limited to such description. Those general technical staff classified as the corresponding technical field of this Invention can also make a number of simple inferences or replacement on condition that the concept of this Invention has been followed, which should be regarded as within the protection of this Invention.

The invention claimed is:

1. A method of manufacturing a microfiber artificial leather, the method comprising:

selecting microfiber as pile warp, and yarn as ground warp and ground weft, wherein the pile warp adopts V-shaped or W-shaped consolidation, uses the double warp-pile weaving technology to weave into double-layer pile fabric on pile weavers, and uses pile cutters to cut the pile warp thread joining the two layers of ground fabric so that the double-layer pile fabric is halved into single-layer pile fabric respectively with ground warp, ground weft and V-shaped or W-shaped pile warp to form a hair surface, featuring a three-dimensional structure;

immersing the pile fabric in a polyurethane finishing liquid, padding the pile fabric, then treating the pile fabric in a coagulating liquid;

washing and drying the pile fabric so that the polyurethane in the pile fabric forms a continuous microporous membrane;

after drying, applying an alkali treatment to the microporous membrane pile fabric comprising polyurethane so that the pile warp is fully dispersed into single fibers to form microfibers, and then fully washing the microfibers in water to remove alkali liquid remaining from the alkali treatment, as well as alkali-soluble monomers and oligomers;

carrying out sanding, dyeing and finishing operations to obtain microfiber artificial leather.

2. The manufacturing method of claim 1, wherein the microfiber is a polyester microfiber, polytrimethylene terephthalate (PTT) microfiber, polyamide 6 (PA6) or polyamide 66 (PA66) microfiber, and the yarn is a filament.

3. The manufacturing method of claim 2, wherein the microfiber is sea-island microfiber or split microfiber.

4. The manufacturing method of claim 3, wherein the microfiber has a multi-filament size of 82.5-333 dtex.

5. The manufacturing method of claim 4, wherein the microfiber has a filament size of 0.55 dtex8 or below.

6. The manufacturing method of claim 2, wherein the described yarn has a multi-filament size of 82.5-222 dtex.

7. The manufacturing method of claim 2, wherein the polyester microfiber is selected from flame-retardant polyester microfiber, anti-static polyester microfiber, antibacterial polyester microfiber, or polyester microfiber with the function to emit negative ions of oxygen.

8. The manufacturing method of claim 1, wherein the polyurethane resin finishing liquid is a solution comprising polyurethane resin, dimethyl formamide (DMF), and anionic and non-ionic surfactants.

9. The manufacturing method of claim 8, wherein the polyurethane resin finishing liquid has a polyurethane resin content in a range of from 5%-30% by weight of the polyurethane resin finishing liquid, and a anionic and nonionic surfactants content in a range of from 0-5% by weight of the polyurethane resin finishing liquid.

10. The manufacturing method of claim 9, wherein the polyurethane resin content is in a range of from 10%-20% by weight of the finishing liquid, and the anionic and nonionic surfactants content is in a range of from 1%-3% by weight of the polyurethane resin finishing liquid.

11. The manufacturing method of claim 1, wherein a weight ratio between the polyurethane finishing liquid and pile fabric is in a range of from 0.8:1 to 4:1.

12. The manufacturing method of claim 11, wherein the weight ratio between the polyurethane finishing liquid and pile fabric is in a range of from 1:1 to 2:1.

13. The manufacturing method of claim 1, wherein the coagulating liquid is a dimethyl formamide (DMF) solution, where the DMF is present in an amount of from 10-30% by weight of the coagulating liquid.

14. The manufacturing method of claim 1, wherein the alkali treatment occurs at a temperature of 95-120 degrees Celsius and for a duration of 10-30 minutes.

15. The manufacturing method of claim 1, wherein a yarn dyed before spinning is selected as the ground warp and ground weft.

16. The manufacturing method of claim 1, wherein a microfiber dyed before spinning is selected as the pile warp.

17. The manufacturing method of claim 1, further comprising: after the pile fabric has been made, coating a layer of sea-island microfiber polyester non-woven fabric on the back of the hair surface.

18. The manufacturing method of claim 1, further comprising: after the microfiber artificial leather has been made, coating a layer of water-soluble polyurethane on the back of the hair surface.

* * * * *